United States Patent [19]

Okamoto

[11] 4,067,097

[45] Jan. 10, 1978

[54] METHOD OF AND ARRANGEMENT FOR BUILDING CYLINDRICAL HOLLOW STRUCTURE

[75] Inventor: Chikashi Okamoto, Yokka-Ichi, Japan

[73] Assignee: Nippon Kakoki Company, Limited, Tokyo, Japan

[21] Appl. No.: 731,100

[22] Filed: Oct. 8, 1976

[30] Foreign Application Priority Data

Oct. 10, 1975 Japan ..... 50-122058

[51] Int. Cl.[2] ..... B21D 39/03

[52] U.S. Cl. ..... 29/429; 52/745; 52/747

[58] Field of Search ..... 220/1 B; 52/745, 746, 52/747, 741; 254/89, 93, 104; 29/429, 430, 431

[56] References Cited

U.S. PATENT DOCUMENTS

| | | | |
|---|---|---|---|
| 2,751,672 | 6/1956 | Reed | 220/1 B |
| 2,866,261 | 12/1958 | Macku | 220/1 B X |
| 3,182,958 | 5/1965 | Peterzon-Arbella | 29/429 |
| 3,380,147 | 4/1968 | McDonald | 52/745 X |

FOREIGN PATENT DOCUMENTS

| | | | |
|---|---|---|---|
| 833,466 | 4/1960 | United Kingdom | 29/429 |

*Primary Examiner*—John E. Murtagh
*Attorney, Agent, or Firm*—Haseltine, Lake & Waters

[57] ABSTRACT

A method of and an arrangement for building a cylindrical hollow structure such as a fluid storage tank, wherein lower and upper structural units to form lowermost and uppermost side wall portions of the hollow structure have helical upper and lower edges, respectively, and the upper structural unit is stepwise rotated about its axis and moved upwardly over the lower structural unit by the use of an open-end chain of link units supporting the upper structural unit in weight transmitting relationship to the lower structural unit through carriers rollably mounted on the helical upper edge of the lower structural unit while applying additional structural members to the upper structural unit for forming part of an intermediate side wall portion of the hollow structure and thereafter applying additional structural members to the helical lower edge of the intermediate side wall portion being constructed.

14 Claims, 7 Drawing Figures

METHOD OF AND ARRANGEMENT FOR BUILDING CYLINDRICAL HOLLOW STRUCTURE

The present invention relates to construction of a cylindrical hollow structure such as, typically, an aboveground fluid storage tank having an open top or a stayed or unstayed top wall or roof. More particularly, the present invention is concerned with a method of building such a hollow structure without use of any lifting means and scaffoldings and further with a mechanical arrangement adapted to put the method into practice.

When large-sized above-ground fluid storage tanks are to be constructed in industrial areas bristling with erections and ancillary equipment, it is often experienced that the use of lifting means such as lifts, hoists or cranes and flying or elevated scaffoldings is restricted, sometimes prohibitingly, because of the limited spaces available and for the sake of safety in construction work. To provide a solution to this problem, a method has been proposed to build a tank by slowly moving an upper structural unit upwardly over a lower structural unit which is fixed on or over the ground while maintaining the former in weight transmitting relationship to the latter. A number of additional structural members are successively applied to the upper structural unit so as to form an intermediate side wall portion between the lower and upper structural units. When the tank body is completed, the lower and upper structural units constitute the lowermost and uppermost side wall portions, respectively, of the tank body with the above mentioned intermediate side wall portion connected therebetween.

Representative examples of practical arrangements adapted to carry out the above described prior-art method are disclosed in German Patent No. 1,132,315 and Japanese Patent No. 654,375 to the best of the inventor's knowledge.

Various drawbacks are, however, involved in these prior-art techniques, including the difficulties in accurately maintaining the upper structural unit in alignment with the lower structural unit, the lack of stability in supporting the upper structural unit in weight transmitting reltionship to the lower structural unit, and the requirement for a number of operators on the lookout for undue or irregular movement of the upper structural unit, as will be discussed on a more realistic basis with reference to the drawings. A prime object of the present invention is to provide a method and an arrangement which are free from these drawbacks inherent in the prior-art techniques.

In accordance with one important aspect of the present invention, there is provided a method of building a cylindrical hollow structure, comprising (1) preparing separate lower and upper structural units having substantially congruent circular cross sections, the lower structural unit having a helical upper edge having lowermost and uppermost ends and continuously sloping upwardly from the lowermost end to the uppermost end and a vertical edge joining the lowermost and uppermost ends of the helical upper edge and the upper structural unit having a helical lower edge having uppermost and lowermost ends and continuously sloping downwardly from the uppermost end to the lowermost end and a vertical edge joining the uppermost and lowermost ends of the helical lower edge, the respective helix curves of the helical upper and lower edges of the lower and upper structural units being substantially identical with each other, (2) positioning a plurality of carriers on the helical upper edge of the lower structural unit at predetermined intervals throughout the length of the upper edge, each of the carriers being in rollable contact with the helical upper edge, and an open-end chain of link units on said carriers, the link units being pivotally connected to one another and each having a cross wall portion having substantially flat lower and upper faces located above the adjacent portion of the helical upper edge of the lower structural unit, each of the link units having at least one of the carriers located below the cross wall portion thereof, (3) mounting the upper structural unit on the open-end chain in weight transmitting relationship to the lower structural unit through the cross wall portions of the link units and the carriers, the vertical edge of the upper structural unit being located adjacent to the vertical edge of the lower structural unit, (4) intermittently driving the open-end chain for stepwise moving the chain along the helical upper edge of the lower structural unit with the carriers in rolling contact with the helical upper edge, the upper structural unit being thereby stepwise rotated about the vertical center axis thereof and moved upwardly over the lower structural unit and the vertical edge of the upper structural unit being stepwise spaced apart from the vertical edge of the lower structural unit for forming a generally parallelogrammic open space between the respective vertical edges of the lower and upper structural units, (5) securely connecting an additional structural unit edgewise to the upper structural unit through the open space between the vertical edges, the additional structural unit thus connected to the upper structural unit having a vertical edge slightly spaced apart from the vertical edge of the lower structural unit, (6) repeating the step of (5) a predetermined number of times for successively applying a plurality of additional structural members to the upper structural unit and the additional structural members precedingly applied to the upper structural unit for thereby forming part of an intermediate side wall portion of the hollow structure to be built, (7) further applying additional structural members to the intermediate side wall portion being completed and to the structural members precedingly applied to the incomplete intermediate side wall portion until the upper structural unit is raised to a desired level, (8) lifting intermediate side wall portion and the upper structural unit above the chain of the link units, and (9) removing the chain and the carriers from both of the upper structural structural unit and the intermediate side wall portion. In intermittently driving the chain of the link units, driving forces substantially totally directed in parallel with the helical upper and lower edges of the lower and upper structural units, respectively, are applied to the chain preferably on both sides of the chain.

In accordance with another important aspect of the present invention, there is provided an arrangement comprising a plurality of carriers to be rollably mounted at predetermined intervals on the helical upper edge of the above mentioned lower structural unit, an open-end chain composed of a number of link units which are pivotally connected to one another each with a horizontal pivotal axis directed substantially at right angles to the direction of elongation of the chain, each of the above mentioned link units having a cross wall portion which has substantially flat lower and upper faces, each link unit being adapted to be mounted on at least one of the carriers positioned on the helical upper edge of the lower structural unit with the lower face of its cross wall portion located above the aforesaid at least one of the carriers, the upper faces of the respective cross wall portions of the individual link units being adapted to receive thereon the helical lower edge of the upper structural unit, and drive means to be mounted on at least one of the inner and outer peripheral surfaces of the lower structural unit and located to be engageable with the link units constituting the open-end chain for thereby intermittently applying driving forces to the chain of the link units for stepwise moving the chain upwardly along the upper helical edge of the lower structural unit, the drive means being operative so that the driving forces which are applied from the drive means to the chain of the link units are substantially totally parallel with the helical upper and lower edges of the lower and upper structural units, respectively.

The drawbacks inherent in prior-art tank building techniques and the advantages of a method and an arrangement according to the present invention over such drawbacks will be more clearly understood from the following description taken in conjunction with the accompanying drawings, in which like reference numerals designate corresponding members, units and structures in some figures and in which.

Figure 1:
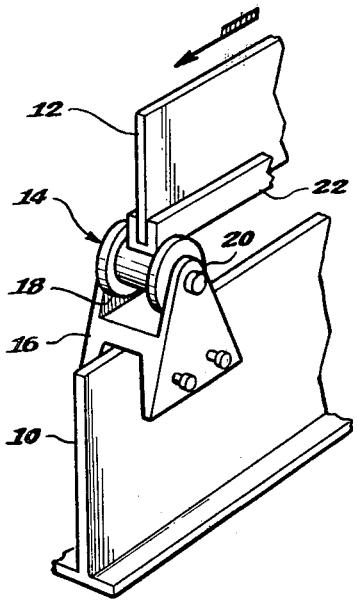
FIG. 1 PRIOR ART
FIG. 1 is a perspective view showing a device used in a prior-art arrangement for building a fluid storage tank.
Figure 2:
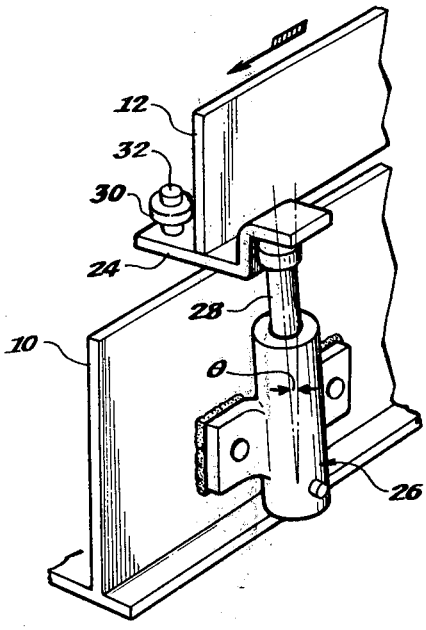
FIG. 2 PRIOR ART
FIG. 2 is a view similar to FIG. 1 but shows a device which is used in another prior-art tank building arrangement.

Referring to FIGS. 1 and 2 of the drawings, there are shown representative examples of conventional tank building arrangements each using lower and upper structural units 10 and 12 as basic or starting members to construct a cylindrical fluid storage tank. While both of the lower and upper structural units 10 and 12 have generally cylindrical configurations, the lower structural unit 10 has an upwardly sloping helical upper edge and the upper structural unit 12 has a downwardly sloping helical lower edge conforming to the upper edge of the lower structural unit 10, though not clearly seen in FIGS. 1 and 2. The tank building arrangement shown in FIG. 1 in particular is adapted to carry out the method disclosed in the previously cited German Patent No. 1,132,315 and uses a plurality of stationary carriers only one of which is shown at 14. The carrier 14 comprises a rigid bracket 16 which is fixedly mounted on the lower structural unit 10 by bolts in such a manner as to straddle the structural unit 10. The bracket 16 has a horizontal cross wall portion perpendicularly bearing against the upper edge of the structural unit 10 and a pair of spaced parallel upper wall portions projecting upwardly from both ends of the cross wall portion, as illustrated. A flanged roller 18 is rotatable on a shaft 20 which extends in parallel with and over the horizontal cross wall portion of the bracket 16 and which is connected at its ends to the upper wall portions of the bracket. The carriers each constructed in this fashion are located at intervals of approximately 2,000 to 3,000 millimeters on the lower structural unit 10.

During construction of the tank, the upper structural unit 12 is positioned on the rollers of the individual carriers and is driven in a suitable manner to ride on the rollers so as to slowly turn about the center axis thereof and simultaneously ascend along the upwardly sloping helical upper edge of the lower structural unit 10. As the upper structural unit 12 is thus moved, there is produced an open space between the lower and upper structural units 10 and 12. Additional structural members (not shown) are successively applied to the upper structural unit 12 so as to form an intermediate side wall portion between the lower and upper structural units 10 and 12. When the upper structural unit 10 is elevated to a desired height and the intermediate side wall portion of the tank is complete, the carriers are removed from the tank by lifting the intermediate side wall portion over the lower structural unit 10 together with the uppermost side wall portion resulting from the upper structural unit 10 in a suitable fashion.

When the upper structural unit 12 is being moved on the rollers 18 of the carriers 14, the weight of the structural unit 12 and the weights of the structural members successively applied to the structural unit 12 are totally borne by the rollers so that the rollers 18 tend to downwardly stick to the shafts 20 supporting the rollers. This causes the upper structural unit 12 to tend to slip on the rollers 18 and to consequently produce an undue stress therein. Such a tendency could be alleviated if the rollers 18 are sized to have sufficiently large diameters of, for example, 250 to 300 millimeters so that an adequate frictional force is produced between the lower edge of the upper structural unit 12 and each of the rollers 18. Provision of such large-sized rollers between the lower and upper structural units 10 and 12 results in enlargement of the gap between the helical edges of the structural units 10 and 12 and makes it difficult to secure the stability of the upper structural unit 12 supported over the lower structural unit 10. From another point of view, increasing the diameter of the roller 18 inevitably necessitates increasing the axial length of the roller. If the roller 18 is thus designed to have an elongated configuration, more allowance would be provided for the upper structural unit 12 to move on the roller 18 in the axial direction of the roller so that not only a difficulty will be encountered in accurately positioning the upper structural unit 12 in weight transmitting relationship to the lower structural unit 10 through the carrier 14 but the upper structural unit 12 may be dislocated from the position aligned with the lower structural unit 10 in the event an external force is applied sidewise to the upper structural unit 12. This also impairs the stability of the upper structural unit 12 supported over the lower structural unit 10. If a tank is to be constructed in an area which is subject to frequent earthquakes or violent gusts of wind, the lack of stability in supporting the upper structural unit 12 might invite serious accidents during construction of the tank. To provide a solution to the above described problems, German Patent No.

1,132,315 proposes to use a grooved guide member 22 fixedly but detachably fitted to the lower edge of the upper structural unit 12. The guide member 22 lends itself to the purpose of increasing the line of contact with the roller 18 and accordingly the frictional force exerted on the roller without resort to increasing the axial length of the roller. Provision of the guide members 22, however, results in enlargement of the spacing between the helical edges of the lower and upper structural units 10 and 12 and, as a consequence, not only impairs the stability of the upper structural unit 12 supported over the lower structural unit 10 but will create difficulties in jacking up the upper structural unit 12 together with the intermediate side wall portion of the tank for removing the carriers 14 and the guide member 22 from the tank body when assemblage of the tank is complete.

On the other hand, the tank building arrangement illustrated in FIG. 2 is disclosed in the previously mentioned Japanese Patent No. 654,375 and is characterized by the use of a combination of a rigid insert 24 and a hydraulic jack 26. The rigid insert 24 is closely interposed between the helical upper and lower edges of the lower and upper structural units 10 and 12, respectively, with its end portions projecting perpendicularly from the gap between the edges as shown. The hydraulic jack 26 has a cylinder fixedly mounted on one peripheral surface of the lower structural unit 10 by bolts and a plunger 28 projecting generally upwardly from the cylinder for engagement at its upper end with the lower face of a raised end portion of the insert 24. The jack 26 in its entirety is inclined a small angle to the vertical toward the direction in which the upper structural unit 12 is to be moved along the helical upper edge of the lower structural unit 10, as indicated by $\theta$ (which angle is set at approximately 3 degrees according to the description of the reference cited). When, thus, the hydraulic jack 26 is actuated to have the plunger 28 alternately moved up and down with its upper end held in engagement with the lower face of the raised end portion of the insert 24, the insert 24 is driven to alternately tilt and fall about one of the side edges thereof so that the upper structural unit 12 supported on the lower structural unit 10 through a plurality of inserts 24 is caused to "crawl" along the upwardly slanting helical upper edge of the lower structural unit 10 by the horizontal component of the force exerted by each of the hydraulic jacks 26 on each of the inserts 24. When the plunger 28 of the jack 26 is thus moved upwardly, the insert 24 is urged to turn not only about one of its side edges perpendicular to the helical edges of the structural unit 10 and 12 but about an axis parallel with the upper and lower edges of the structural units 10 and 12. The upper structural unit 12 is therefore urged away from the raised end portion of the insert 24 and accordingly tends to be moved out of alignment with the lower structural unit 10. To prevent the upper structural unit 12 from being thus dislocated from the position aligned with the lower structural unit 10, a roller 30 is mounted on the other end portion of the insert 24 by a vertical shaft 32 so as to be in rolling contact with the upper structural unit 12 when the structural unit 12 is urged away from the raised end portion of the insert 24 opposite to the roller 30. Difficulties are, however, encountered in maintaining a number of inserts 24 in correct positions relative to the lower and upper structural units 10 and 12 in such a manner that the forces exerted thereon from the respectively associated hydraulic jacks 26 are uniformly transmitted to the upper structural unit 12 and that the rollers 30 on the inserts 24 are all held in the initially determined positions relative to the upper structural unit 12 throughout the operation to construct the tank. Furthermore, extremely meticulous efforts are required in mounting a number of hydraulic jacks 26 on the lower structural unit 10 in such a manner that the hydraulic jacks are all held in correct angular positions relative to the structural unit 10.

The present invention aims at elimination of all these drawbacks inherent in prior-art tank building techniques of the above described natures.

Figure 3:
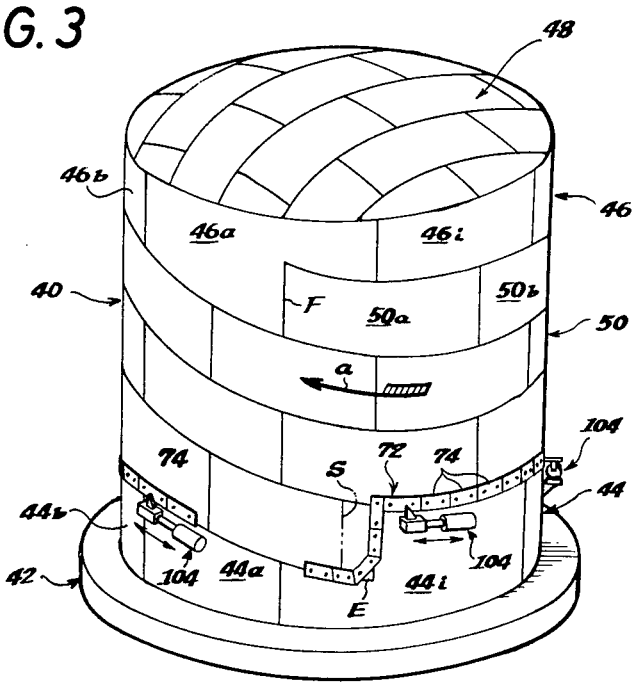
FIG. 3 is a perspective view showing a fluid storage tank which is under construction by the use of a method and an arrangement proposed by the present invention.

Referring to FIG. 3, there is schematically shown an above-ground fluid storage tank which is under construction with use of the method and mechanical arrangement proposed by the present invention. When the fluid storage tank is completed, the same comprises a generally cylindrical tank body 40 and a bottom plate 42 on which the tank body 40 is fixedly mounted, the bottom plate 42 being assumed by way of example as closing the lower end of the tank body 40 in a gas-tight or liquid-tight fashion. The present invention is, in essence, directed at the construction of the tank body 40 and uses, as starting members, lower and upper structural units 44 and 46 which are initially separate from each other and which have substantially congruent circular cross sections having substantially equal inside and outside diameters. The lower structural unit 44 has a horizontal circular lower edge welded or otherwise hermetically fixed on the upper face of the bottom plate 42 and a helical upper edge continuously sloping upwardly between lowermost and uppermost ends which are joined together by a vertical edge E. The upper structural unit 46 is a vertically inverted version of the lower structural unit 44 and, thus, has a horizontal circular upper edge and a helical lower edge continuously sloping downwardly between uppermost and lowermost ends which are joined together by a vertical edge F. The circular helix curves described by the upper and lower helical edges of the lower and upper structural units 44 and 46 are substantially identical with each other and as a corollary the respective vertical edges E and F of the structural units 44 and 46 have substantially equal lengths. The lower structural unit 44 is assumed to be constructed by a number of structural members **44*a*, 44*b* . . . 44*i* which are edgewise securely connected to one another and, likewise, the upper structural unit 46 is assumed to be constructed by a number of structural members 46*a*, 46*b*, . . . 46*i* which are edgewise securely connected to one another. The above mentioned vertical edges E and F of the lower and upper structural units 44 and 46 are assumed to be formed on the structural members 44*i* and 46*a* of the structural units 44 and 46, respectively. If desired, however, each of the lower and upper structural units 44 and 46** may be constructed as a unitary member having the above described configuration as a whole.

Prior to construction of the tank, a top wall unit 48 is welded or otherwise securely connected to the upper edge of the upper structural unit 46 so that the upper structural unit 46 is hermetically closed at its upper end. The top wall unit 48 is shown by way of example as having a flat and circular configuration as a whole but may be shaped otherwise so as to have a dome-like or cowl-like configuration for example. The top wall is also shown consisting of a number of structural members edgewise connected together but may be constructed of a single unitary member, if desired. The gist of the present invention resides in the construction of the tank body 40 as previously alluded to and, for this reason, the fluid storage tank to be constructed by the use of the method and arrangement according to the present invention may be void of the bottom plate 42 and the above described top wall unit 48.

Figure 6:
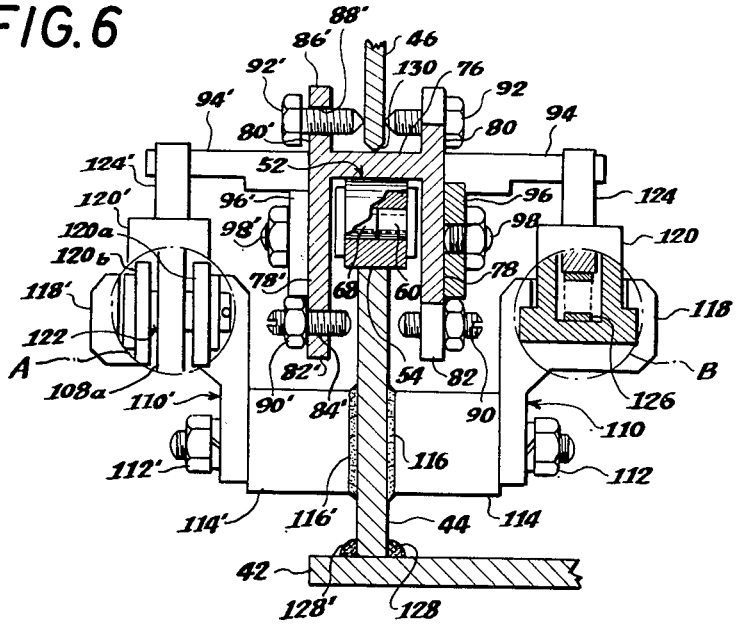
FIG. 6 is a cross sectional view of important members and units of the embodiment illustrated in FIG. 4.
Figure 4:
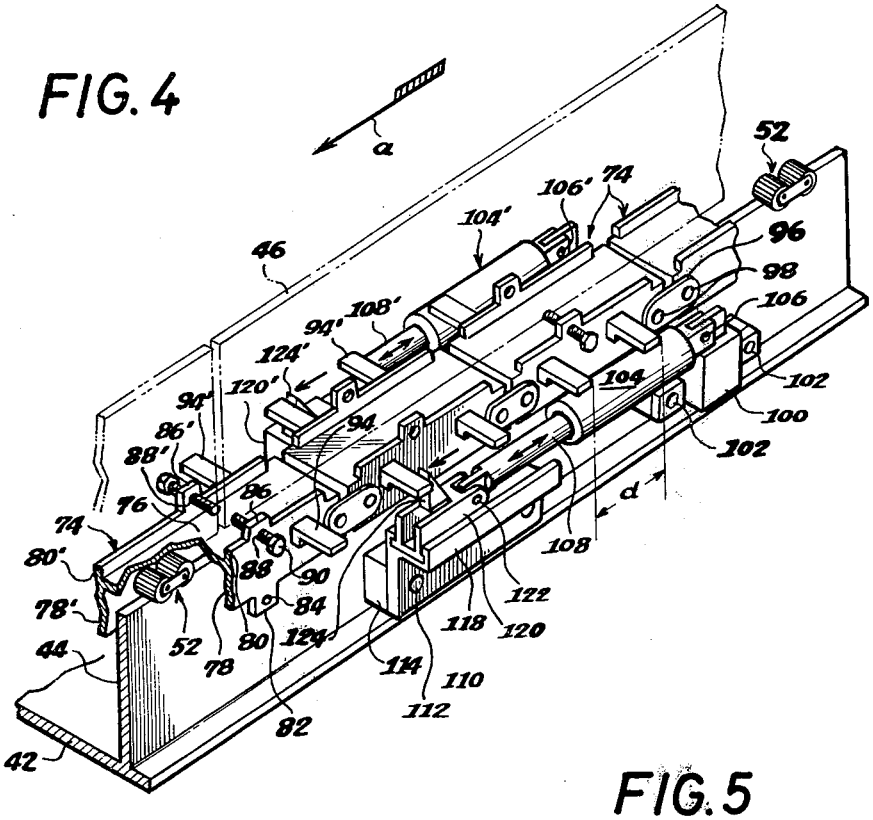
FIG. 4 is a fragmentary perspective view showing part of a preferred embodiment of the arrangement for building a cylindrical hollow structure such as a fluid storage tank in accordance with the present invention.
Figure 5:
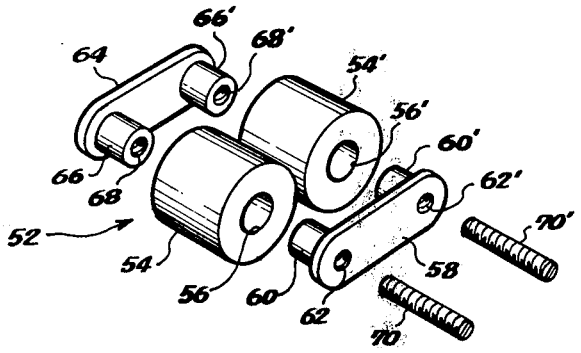
FIG. 5 is an exploded perspective view showing one of the carriers forming part of the embodiment of FIG. 4, the carrier being illustrated in a disassembled condition.

For the construction of the fluid storage tank from the lower and upper structural units 44 and 46 used as the starting members, a number of structural members are successively interposed between the lower and upper structural units 44 and 46 until the upper structural unit 46 is lifted to a desired height and an intermediate side wall portion 50 is formed in a gapless fashion between the helical upper and lower edges of the lower and upper structural units 44 and 46, respectively. When the tank body 40 is thus complete with the intermediate side wall portion 50, the initial lower and upper structural units 44 and 46 constitute lowermost and uppermost side wall portions, respectively, which are vertically spaced apart from each other across the intermediate side wall portion 50. The purpose of the present invention is to have the upper structural unit 46 lifted over the lower structural unit 44 without use of any lifting means such as a lift, hoist or crane and to form the intermediate side wall portion without use of any flying or elevated scaffoldings. FIGS. 4 to 6 illustrate a preferred embodiment of the mechanical arrangement adapted to carry out the method to accomplish such a purpose.

Referring concurrently to FIGS. 4 to 5 as well as to FIG. 3, the tank building arrangement embodying the present invention comprises a number of carriers 52 which are, when in use, rollably mounted on the helical upper edge of the lower structural unit 44 as shown in FIG. 4. Each of the carriers 52 comprises, as illustrated to an enlarged scale and in a disassembled condition in FIG. 5, a pair of spaced parallel rollers 54 and 54' having equal diameters and equal axial lengths and formed with axial bores 56 and 56', respectively, which are open at their ends. While the diameter of each of the rollers 54 and 54' may be selected arbitarily depending upon the dimensions of the fluid storage tank to be constructed or, more specifically, the sizes of the lower and upper structural unit 44 and 46 to be used for the construction of the tank, it is preferable that the diameter of each roller be within the range of about 28 to 45 millimeters for the construction of an ordinarily sized petroleum storage tank of the above ground type. The axial length of each of the rollers is slightly greater than the thickness or thicknesses of the structural members to be used to construct the side wall structure of the tank body 40. The carrier 52 further comprises an elongated link member 58 having a pair of spaced parallel cantilever shafts 60 and 60' formed with internally threaded axial bores (not shown) which are open through internally threaded holes 62 and 62', respectively, formed in the link member 58. Likewise, an elongated link member 64 has a pair of spaced parallel cantilever shafts 66 and 66' formed with internally threaded axial bores 68 and 68' which are open through internally threaded holes (not shown) formed in the link member 64. The cantilever shafts 60 and 66 on the link members 58 and 64, respectively, are slidably inserted into the axial bore 56 in one roller 54 from the axial ends of the bore 56 with their respective ends in contact with each other as will be seen in FIG. 6 and, likewise, the cantilever shafts 60 and 66' on the link members 58 and 64' respectively, are slidably inserted into the axial bore 56' in the other roller 54' from the axial ends of the bore 56' with their respective leading ends in contact with each other. The roller 54 is thus rotatable on the shafts 60 and 66 on the link members 58 and 64, respectively, and the roller 54' is rotatably on the shafts 60' and 66' on the link members 58 and 64, respectively. The link members 58 and 64 thus assembled to the rollers 54 and 54' are fastened together by an externally threaded pin 70 screwed into the internally threaded axial bores in the aligned cantilever shafts 60 and 66 and an externally threaded pin 70' screwed into the internally threaded axial bores in the aligned cantilever shafts 60' and 66'. During construction of the tank, the carriers 52 thus constructed are mounted at substantially regular intervals on the helical upper edge of the lower structural unit 44 in such a manner that each of the carriers 52 has its rollers 54 and 54' in rollable contact with the upper edge of the structural unit 44 as will be best seen in FIG. 4.

The tank building arrangement embodying the present invention further comprises an open-end chain 72 composed of a number of link units 74 as schematically illustrated in FIG. 3. As will be more clearly seen in FIGS. 4 and 6, each of the link units 74 has a generally H-shaped cross section and comprises a horizontal cross wall portion 76 having substantially flat upper and lower faces, a pair of spaced parallel lower side wall portions 78 and 78' extending downwardly from the side ends of the cross wall portion 76, and a pair of spaced parallel upper side wall portions 80 and 80' extending upwardly from the side ends of the cross wall portion 76. Though not clearly seen in the drawings, the link unit 74 further has end wall portions at the fore and aft ends of the lower side wall portions 78 and 78'.

The lower side wall portions 78 and 78' of the link unit 74 have downward projections 82 and 82' formed with internally threaded holes 84 and 84', respectively, having center axes substantially normal to the side faces of the wall portions 78 and 78' and preferably aligned with each other (FIG. 6). Likewise, the upper side wall portions 80 and 80' have upward projections 86 and 86' which are formed with internally threaded holes 88 and 88', respectively, having center axes substantially normal to the side faces of the wall portions 80 and 80' and preferably aligned with each other (FIG. 4). The internally threaded holes 84 and 84' in the downward projections 82 and 82' of the lower side wall portions 78 and 78' are adapted to have bolts 90 and 90' respectively screwed therethrough and likewise the internally threaded holes 88 and 88' in the upward projections 86 and 86' of the upper side wall portions 80 and 80' are adapted to have bolts 92 and 92' respectively screwed therethrough.

The link unit 74 has fixedly mounted thereon a suitable number of lateral arms 94 (shown as two in number by way of example) perpendicularly projecting from one outer side face of the link unit 74 and spaced apart a predetermined distance from each other in a direction parallel with the longitudinal direction of the link unit 74 and a suitable number of lateral arms 94' (also shown as two in number) perpendicularly projecting from the other side face of the link unit 74 and spaced apart a predetermined distance from each other in a direction parallel with the above mentioned longitudinal direction of the link unit 74. The lateral arms 94 and 94' on the opposite side faces of the link unit 74 are preferably aligned with each other in lateral directions of the link member 74 so that the distance between the lateral arms on one side face of the link unit 74 is substantially equal to the lateral arms 94' on the other side face of the link unit 74, as will be best seen from FIG. 4.

The link units 74 each constructed and arranged in the above described fashion are connected to one another by connecting elements 96 and 96' (FIG. 6). Each of the connecting elements 96 and 96' is pivotally connected by bolts or studs 98 and 98' to the side faces of every two neighboring link units 74 so that the link units 74 and connecting elements 96 and 96' constitute the chain 72 having free ends constituted by the foremost and rearmost ones of the link units 74. In this instance, it is important that the connecting elements 96 and 96' be arranged in such a manner that all of the lateral arms 94 and 94' projecting laterally from the chain 72 of the link units 74 are spaced apart from each other a distance equal to the distance between the lateral arms on each of the link units 74 in the longitudinal direction of the chain 72. When the chain 72 thus constructed and arranged is in use, each of the link units 74 has the flat lower face of its cross wall portion 76 received on the rollers 54 and 54' of the carriers 52 mounted on the helical upper edge of the lower structural unit 44 and has its lower side wall portions 78 and 78' located on both sides of the carriers 52 underneath the cross wall portion 76, as will be best seen in FIG. 6. The spacing between each of the lower side wall portions 78 and 78' and the adjacent peripheral surface portion of the lower structural unit 44 thus supporting the carriers 52 and the link unit 74 can be varied by adjustment of the relative positions of the bolts 90 and 90' to each other on both sides of the lower structural unit 44. When, however, the bolts 90 and 90' are removed from the side wall portions 78 and 78', respectively, or unscrewed to have their leading ends located flush with or withdrawn from the inner faces of the side wall portions 78 and 78', respectively, the link unit 74 is laterally movable together with the carriers 52 associated therewith relative to the lower structural unit 44 between a position having one of the side wall portions 78 and 78' in contact with the adjacent surface portion of the lower structural unit 44 and a position having the other side wall portion in contact with the adjacent surface portion of the structural unit 44. The upper side wall portions 80 and 80' are shown spaced apart from each other a distance substantially equal to the spacing between the lower side wall portions 78 and 78', by way of example. The spacing between the upper side wall portions 80 and 80' may however be selected arbitarily irrespective of the spacing between the lower side wall portions 78 and 78' insofar as the spacing between the upper side wall portions 80 and 80' is larger than the thickness of a structural member forming part of the upper structural unit 46 or a structural member to form part of the previously mentioned intermediate side wall portion 50 of the tank body 40 (FIG. 3) to be constructed. During an incipient stage of construction of the tank, the upper structural unit 46 is mounted on the link units 74 with its helical lower edge bearing against the flat upper face of the cross wall portion 76 of each link unit 74 so that the individual link units 74 are in weight bearing relationship to the upper structural unit 46 and in weight transmitting relationship to the lower structural unit 44 across the carriers 52. The number of the carriers 52 to be accommodated within each of the link units 74 is herein assumed to be two by way of example but only one carrier or more than two carriers may be allocated to each of the link units 74 if desired.

The tank building arrangement embodying the present invention further comprises drive means for stepwise moving the above described chain 72 of the link unit 74 over and along the helical upper edge of the lower structural unit 44 with the carriers 52 in rolling contact with the edge. The drive means comprises a number of drive units which are positioned on the inner and outer peripheral surfaces of the lower structural unit 44. Each of the drive units comprises a stationary bracket 100 which is fixedly but detachably mounted on each of the inner and outer peripheral surfaces of the lower structural unit 44 by suitable fastening means such as bolts 102 as shown in FIG. 4. A fluid-operated cylinder 104 is pivotally connected by a pin 106 to the bracket 100 so as to be rotatable about an axis substantially normal to the adjacent peripheral surface portion of the lower structural unit 44. The fluid-operated cylinder 104 has a movable plunger 108 projecting in a direction opposite to the pin 106 and thus axially movable toward and away from the pin 106. An elongated bracket 110 is located at a suitable spacing from the above mentioned bracket 100 supporting the cylinder 104 and is fixedly but detachably mounted by suitable fastening means such as bolts 102 on a side face of a supporting block 114 which is welded as at 116 (FIG. 6) or otherwise fixedly attached to the adjacent peripheral surface portion of the structural unit 44. The bracket 110 has a guide rail portion 118 formed with an elongated groove having an open upper end and extending substantially in parallel with the adjacent portion of the helical upper edge of the structural unit 44. The bracket 110 is positioned relative to the fluid-operated cylinder 104 so that the plunger 108 of the cylinder 104 is axially movable over and along the elongated groove in the guide rail portion 118 when the cylinder 104 assumes an approximately horizontal angular position substantially parallel with the adjacent portion of the helical upper edge of the lower structural unit 44, as will be seen in FIG. 4. A slider 120 having a generally U-shaped cross section is longitudinally slidable in the groove in the guide rail portion 118 of the bracket 110. The plunger 108 of the cylinder 104 is pivotally connected at its leading end to the slider 120 by a pin 122 extending at right angles to the direction of movement of the slider 120. The slider 120 is thus movable back and forth along the groove in the guide rail portion 118 of the bracket 110 when the cylinder 104 is in the above mentioned angular position substantially parallel with the adjacent portion of the upper edge of the lower structural unit 44 as illustrated in FIG. 4. On the opposite side of the lower structural unit 44 is also provided a drive unit is entirely similar to the above described drive unit and which thus comprises a fluid-operated cylinder 104' pivotally connected by a pin 106' to a stationary bracket (not shown) corresponding to the above described bracket 100. The cylinder 104' has a movable plunger 108' pivotally connected by a pin 122' to a slider 120' on a guide rail portion 118' of an elongated bracket 110'. As illustrated in a circular spot to indicated by A in FIG. 6 the slider 120' has a pair of spaced parallel side wall portions 120*a* and 120 *b* to which the pin 122' is connected at the opposite ends thereof. The plunger 108 of the above described fluid-operated cylinder 104 is connected to the slider 120 in a similar manner. The bracket 110 supporting the slider 120' is fixedly mounted by bolts 112 on a side face of a supporting block 114' which is welded as at 116 to the lower structural unit 44, as illustrated in FIG. 6.

Each of the sliders 120 and 120' above mentioned is formed with a groove having an open top and extending in parallel with the groove in each of the guide rail portions 118 and 118' of the brackets 110 and 110'. The sliders 120 and 120' have mounted thereon generally wedge-shaped thrust pawls 124 and 124', respectively, each having front and rear faces which meet each other at the upper end of the pawl. The thrust pawls 124 and 124' have lower end portions projecting into the grooves in the sliders 120 and 120', respectively, and are pivotally mounted on the sliders 120 and 120' by pivotal pins (not shown) which are perpendicular to the directions of movement of the sliders 120 and 120', respectively. Each of the thrust pawls 124 and 124' is rotatable about each of the above mentioned pivotal pins between an upright position having its front face on a vertical plane and a tilted position having the front face inclined forwardly downwardly. Each of the sliders 120 and 120' is formed with a cross wall portion adapted to limit the rotation of the associated thrust pawl beyond the upright position away from the tilted position thereof. Each of the thrust pawls 124 and 124' is urged to turn toward the upright position thereof by suitable biasing means such as a leaf spring 126 seated between the lower end of the thrust pawl and the bottom wall portion of the slider as illustrated in the circular spot indicated by B in FIG. 6. All the corresponding parts and members of the drive units thus provided on both sides of the adjacent wall portion of the lower structural unit 44 are preferably positioned similarly relative to the lower structural unit 44, as will be seen from FIG. 4.

The drive units thus constructed and arranged are located at suitable regular or irregular intervals on the inner and outer peripheral surfaces of the lower structural unit 44. When the chain 72 of the link units 74 is mounted over the helical upper edge of the lower structural unit 44 with the drive units thus mounted on the structural unit 44, the lateral arms 94 and 94' projecting from the side faces of the link units 74 hang over the fluid-operated cylinders 104 and 104' and the sliders 120 and 120' of the individual drive units so that the respective thrust pawls 124 and 124' on the sliders 120 and 120' are engageable with the lateral arms 94 and 94', respectively. If, under these conditions, the sliders 120 and 120' are moved forward, viz., away from the respectively associated cylinders 104 and 104', the thrust pawl 124 on the slider 120 of each of the drive units positioned on one side of the lower structural unit 44 has its front face brought into abutting contact with one of the lateral arms 94 projecting from one side of the chain 72 and, likewise, the thrust pawl 124' on the slider 120' of each of the drive units positioned on the other side of the lower structural unit 44 has its front face brought into abutting contact with one of the lateral arms 94' projecting from the other side of the chain 72, as illustrated in FIG. 4. If, thus, the fluid-operated cylinders 104 and 104' of all the drive units are simultaneously actuated to drive the associated sliders 120 and 120' to further move forward, the individual link units 74 constructing the open-end chain 72 are moved together with the carriers 52 along the upwardly slanting helical upper edge of the lower structural unit in a forward direction indicated by arrows *a* in FIGS. 3 and 4. After the chain 72 is thus moved a certain distance in the forward direction, the fluid-operated cylinders 104 and 104' are actuated in reverse directions so that the sliders 120 and 120' are moved backwardly and accordingly the thrust pawls 124 and 124' are disengaged from the lateral arms 94 and 94', respectively, which have been engaged by the thurst pawls 124 and 124'. As the plungers 108 and 108' of the cylinders 104 and 104' are thus caused to retract, the thurst pawl 124 on the slider 120 of each of the drive units on one side of the lower structural unit 44 has its rear face brought into sliding contact with the lateral arm 94 posterior, in the direction of movement of the chain 72, to the lateral arms 94 which has been engaged by the thrust pawl 124 and, likewise, the thrust pawl 124' on the slider 120' of each of the drive units on the other side of the lower structural unit 44 has its rear face brought into sliding contact with the lateral arm 94' posterior to the lateral arm 94' which has been engaged by the thrust pawl 124'. When the thrust pawls 124 and 124' are thus having their rear faces in sliding contact with the lateral arms 94 and 94' newly engaged by the thrust pawls 124 and 124', respectively, the thrust pawls 124 and 124' are forced to turn from their respective upright positions toward the previously tilted positions thereof against the forces of the leaf springs 126 acting on the thrust pawls. When the thrust pawls 124 and 124' are moved back past the newly engaged lateral arms 94 and 94', repectively, the thrust arms 94 and 94' restore the upright positions by the forces of the leaf springs 126 and have their front faces in contact with the newly engaged lateral arms 94 and 94', as in the initial conditions. Each of the fluid-operated cylinders 104 and 104' is thus designed so that the movable plunger thereof has a distance of stroke substantially equal to each of the intervals between the lateral arms 94 and 94' projecting from the chain 72, such intervals being indicated by *d* in FIG. 4.

During construction of the tank body 40 (FIG. 3), the bolts 90 and 90' on the lower side wall portions 78 and 78' of each of the link units 74 of the chain 72 are fully screwed through the internally threaded holes 84 and 84', respectively, so that each link unit 74 is allowed to laterally move relative to the lower structural unit 44 only slightly, as will be understood from the illustration of FIG. 6. When the link units 74 are held in these positions relative to the lower structural unit 44, the fluid-operated cylinders 104 and 104' positioned on both sides of the lower structural unit 44 are located below the lateral arms 94 and 94' sidewise projecting from the link units 74 located adjacent to the cylinders 104 and 104', respectively, and are thus prevented from being rotated about the pins 106 and 106' into the previously mentioned upright positions thereof. When, however, the bolts 90 and 90' on the lower side wall portions 78 and 78' of each of the link units 74 are removed from the side wall portions 78 and 78', respectively, or partially unscrewed through the holes 84 and 84', respectively, each link unit 74 is provided with an allowance to laterally move relative to the lower structural unit 44 between a position having the inner face of one of the side wall portions 78 and 78' in contact with the adjacent surface portion of the lower structural unit 44 and a position having the inner face of the other of the side wall portions 78 and 78' in contact with the adjacent surface portion of the structural unit 44, as previously noted. When each of the link units 74 located adjacent any of the fluid-operated cylinders 104 and 104' is moved into one of these extreme lateral positions relative to the lower structural unit 44, the lateral arms 94 or 94' projecting from one side of each of the link unit 74 is moved from above the particular cylinder 104 or 104' and is withdrawn from the vertical plane on which the cylinder 104 or 104' is rotatable about the pin 106 or 106'. If, thus, the plunger 108 or 108' of the cylinder 104 or 104' is disconnected from the associated slider 120 or 120' by removing the pin 122 or 122' from the plunger 108 or 108' and the slider 120 or 120', respectively, the cylinder 104 or 104' is permitted to rotate into the previously mentioned upright position thereof projecting upwardly from the pin 106 or 106'. The cylinder 104 or 104' moved into the upright position is used as a jack when in removing the chain 72 of the link units 74 and the carriers 52 toward the end of the construction work, as will described in more detail. It is, for this reason, important that the spacing between the lower side wall portions 78 and 78' of each of the link units 74 and the length of each of the lateral amrs 94 and 94' on the link unit 74 be selected in such a manner that the lateral arms 94 and 94' can be moved from above the cylinders 104 and 104', respectively, when the link unit 74 is moved into the previously mentioned extreme lateral positions relative to the lower structural unit 44.

Though not shown in the drawings, furthermore, the fluid-operated cylinders 104 and 104' are all connected by suitable pipelines or conduits to a single master cylinder so that the cylinders 104 and 104' can be actuated all at a time in each of the steps to drive the chain 72.

Description will now be made regarding the operation of the tank building arrangement hereinbefore described.

Prior to construction of the tank, the lower and upper structural units 44 and 46 having the previously described configurations are fabricated from a number of structural members which are shown in FIG. 3 as consisting of structural members 44*a*, 44*b*, . . . 44*i* and 46*a*, 46*b*, . . . 46*i*. The lower structural unit 44 thus fabricated is fixedly mounted on the upper face of the bottom plate 42 and is welded along its lower circular edge to the bottom plate 42 as at 128 (FIG. 6). The drive units each including the bracket 100, supporting block 114, bracket 110, fluid-operated cylinder 104 and slider 120 are then mounted at predetermined intervals on one of the peripheral surfaces of the lower structural unit 44 with the fluid-operated cylinder 104 of each drive unit held in the previously mentioned approximately horizontal angular position substantially parallel with the adjacent portion of the heli-al upper edge of the lower structural unit 44 as shown in FIG. 4. The drive units each including the fluid-operated cylinder 104' and the associated members are also mounted on the other peripheral surface of the lower structural unit 44. In this instance, it is preferable that the drive units on one side of the lower structural unit 44 be arranged to have substantially the same relative positions to the structural unit 44 as those of the drive units on the other side of the structural unit 44, as previously noted. The pipelines or conduits are then connected from all the fluid-operated cylinders 104 and 104' to the previously mentioned master cylinder, though not shown in the drawings. When all these operations are complete or while such operations are under way, the carriers 52 are mounted on the helical upper edge of the lower structural unit 44 at desired intervals throughout the length of the edge in such a manner that the rollers 54 and 54' of each of the carriers 52 are in rollable contact at their lower ends with the upper edge of the structural unit 44. The open-end chain 72 of the units 74 is thereafter placed on these carriers 52 so that the link unit 74 at the foremost free end of the chain 72 is located in proximity to the upper end of the vertical edge E of the lower structural unit 44 and the link unit 74 at the rearmost free end of the chain 72 is located in proximity to the lower end of the vertical edge E, though not illustrated in the drawings. For this purpose, it is important that the open-end chain 72 have a length substantially equal to the length of the helical upper edge of the lower structural unit 44. The previously mentioned intervals at which the carriers 52 are mounted on the upper edge of the structural unit 44 are such that each of the link units 74 of the chain 72 placed on the carriers 52 is capable of receiving two of the carriers 52 on the flat lower face of its cross wall portion 76. The bolts 90 and 90' on the lower side wall portions 78 and 78' of each of the link units 74 are then fully screwed through the holes 84 and 84', respectively, and the link units 74 are adjusted for correct lateral positions relative to the lower structural unit 44 so that each of the link units 74 has its lower side wall portions 78 and 78' substantially equally spaced apart from the adjacent peripheral surface portions of the lower structural unit 44, as illustrated in FIG. 6. Upon completion of the adjustment of the positions of all the link units 74 relative to the lower structural unit 44, the upper structural unit 46 combined with the top wall structure 48 is positioned on the chain 72 of the link units 74 in such a manner that the structural unit 46 bears along its helical lower edge against the flat upper faces of the cross wall portions 76 of all the link units 74. The helical lower edge of the upper structural unit 46 may be bevelled as at (FIG. 6) so that the structural unit 46 can be easily and securely welded to structural members to be applied thereto. The upper structural unit 46 thus mounted on the open-end chain 72 of the link units 74 has its vertical edge F located in close proximity to the vertical edge E of the lower structural unit 44 so that the upper end of the vertical edge F of the upper structural unit 46 is located adjacent to the link unit 74 at the foremost end of the chain 72 and the lower end of the vertical edge F is located adjacent to the link unit 74 at the rearmost end of the chain 72. The bolts 92 and 92' on the upper side wall portions 80 and 80' of each of the link units 74 are then screwed through the holes 88 and 88' until the bolts 80 and 80' have their leading ends brought into contact with the adjacent peripheral surface portions of the upper structural unit 46 and accordingly the upper side wall portions 80 and 80' are substantially equally spaced apart from the above mentioned surface portions, as illustrated in FIG. 6. The upper structural unit 46 is now positioned vertically in alignment with the lower structural unit 44 so that the link units 74 constituting the open-end chain 72 positioned between the structural units 44 and 46 are correctly held in weight transmitting relationship to the lower structural unit 44 through the carriers 44.

When the master cylinder connected to the fluid-operated cylinders 104 and 104' is then put into operation, the cylinders 104 and 104' are simultaneously actuated and cause the respective thrust pawls 124 and 124' on the sliders 120 and 120' of the drive units to successively engage the lateral arms 94 and 94', respectively, projecting from both sides of the chain 72. As the plungers 108 and 108' of the cylinders 104 and 104' are thus moved back and forth alternately, the chain 72 of the link units 74 is moved forwardly and upwardly along the upwardly slanting helical upper edge of the lower structural unit 44 with each of the carriers 52 rolling between the upper edge of the structural unit 44 and the flat lower face of the cross wall portion 76 of the link unit 74 straddling the carrier 52. This causes the upper structural unit 46 to stepwise turn about the center axis of the unit 46 and rise over the lower structural unit 44 with its helical lower edge stepwise moved in a helical path along the upper edge of the lower structural unit 44. As the upper structural unit 46 is thus rotated about the center axis thereof, the vertical edge F of the structural unit 46 is moved away from the vertical edge E of the lower structural unit 44 so as to form a generally parallelogrammic open space between the vertical edges E and F. As the upper structural unit 46 is moved in the above described fashion, furthermore, the link unit 74 at the foremost or leading end of the chain 72 moved along the upper edge of the lower structural unit 44 is moved past the upper end of the vertical edge of the lower structural unit 44 and simultaneously the link unit 74 at the rearmost or trailing end of the chain 72 is moved away from the lower end of the vertical edge E. The spacing between the vertical edges E and F is enlarged and at the same time the chain 72 has its leading end portion moved downwardly along the vertical edge E of the lower structural unit 44, as the upper structural unit 46 is further moved relative to the lower structural unit 44. When the open space between the vertical edges E and F is enlarged to a certain size which is ample enough to accommodate an additional structural member indicated by 50*a* in FIG. 3, the chain 72 has the link units 74 of its leading end portion carried on a lowermost end portion of the upper edge of the lower structural unit 44 by the carriers 52 engaged by the particular link units 74 as will be seen from FIG. 3. The above mentioned additional structural member 50*a* is now edgewise welded partly to the structural members 46*a* and 46*i* of the upper structural unit 46. The additional structural member 50*a* thus connected to the upper structural unit 46 has its lower edge partly received on the upper faces of the cross wall portions 76 of the link units 74 of the leading end portion of the chain 72 and has a vertical edge slightly spaced apart from the vertical edge E of the lower structural unit 44, the vertical edge of the additional structural member 50*a* being indicated by a phantom line S in FIG. 3. The upper structural unit 46 with the additional structural member 50*a* thus applied thereto is further rotated about the center axis of the structural unit 46 and moved upwardly so that a new open space is formed between the vertical edge E of the lower structural unit 44 and the vertical edge S of the additional structural member 50*a*. A second additional structural member 50*b* is then edgewise welded partly to the helical lower edge of the upper structural unit 46 and partly to the vertical edge S of the additional structural member 50*a*. A plurality of additional structural members including the above mentioned structural members 50*a* and 50*b* are in this manner successively applied to the upper structural unit 46, thereby forming part of the previously mentioned intermediate side wall portion 50 of the tank body 40. When the lower edge of the upper structural unit 46 is thus fully occupied by the additional structural members, the structure constituted by the additional structural members has a helical lower edge which is similar to the helical lower edge of the initial upper structural unit 46. Additional structural members are further applied one after another to the "interim" structure forming part of the intermediate side wall portion 50 until the upper structural unit 46 reaches the desired height and accordingly the tank body 40 attains the desired internal capacity. Prior to application of the last additional structural member to the interim structure to form the intermediate side wall portion 50 of the tank body 40, there is formed an open space between the vertical edge E of the lower structural unit 44 and the vertical free edge of the additional structural member finally applied to the interim structure. If, under this condition, the open-end chain 72 happens to extend between the lowermost and uppermost ends of the helical upper edge of the lower structural unit 44, the open space thus left between the vertical edge E and the vertical free edge of the finally applied additional structural member can be closed by applying the last additional structural member to the interim structure so as to complete the intermediate side wall portion 50 of the tank body 40. If, however, the open-end chain 52 happens to have a portion located within such an open space, the open space is left as it is until the chain 72 and the carriers 52 are removed from the lower structural unit 44. The carriers 52 and the chain 72 of the link units 74 can be removed from the lower structural unit 44 in the following manners.

The additional structural members to form part of the intermediate side wall portion 50 of the tank body 40 are provided with brackets (not shown) which are located to be respectively engageable with the leading end portions of the plungers 108 and 108' of the individual fluid-operated cylinders 104 and 104' in the previously mentioned upright positions extending upwardly from the pins 106 and 106', respectively. When the intermediate side wall portion 50 of the tank body 40 is completed or to be completed with the last additional structural member, the bolts 90 and 92 or the bolts 90' and 92' of each of the link units 74 are removed from the lower and upper side wall portions 78 and 80 or the lower and upper side wall portions 78' and 80' or partially unscrewed through the holes 84 and 88 or the holes 84' and 88', respectively. Each of the link units 74 together with the carriers 52 engaged by each link unit is then laterally moved relative to the lower structural unit 44 and the complete or incomplete intermediate side wall portion 50 of the tank body 40 until the inner face of one of the lower side wall portions 78 and 78' is brought into contact with the adjacent peripheral surface portion of the lower structural unit 44. The lateral arms 94 or 94' projecting from one side of each of the link units 74 located adjacent each of the fluid-operated cylinders 104 and 104' are thus moved out of the positions above the cylinder 104 or 104'. If the pin 122 or 122' connecting the cylinder 104 or 104' to the slider 120 or 120' on the bracket 110 or 110', respectively, is removed from the plunger 108 or 108' and the slider 120 or 120', the cylinder 104 or 104' is allowed to turn from the approximately horizontal angular position (which is substantially parallel with the adjacent portion of the helical upper edge of the lower structural unit 44 and which is thus actually slightly inclined to the horizontal) illustrated in FIG. 4 into the upright position projecting upwardly from the pin 106 or 106'. The plungers 108 or 108' of the cylinders 104 or 104' thus moved into the upright positions thereof are then fixedly but detachably connected at their upper ends to the brackets on one peripheral surface of the complete or incomplete intermediate side wall portion 50. The cylinders 104 and 104' on both sides of the lower structural unit 44 can thus be moved into the upright positions thereof by moving each of the link units 74 between the extreme lateral positions thereof relative to the lower structural unit 44. When the cylinders 104 and 104' are all connected at the upper ends of their plungers 108 and 108' to the brackets on the structural members forming part of the complete or incomplete intermediate side wall portion 50 of the tank body 40, the cylinders 104 and 104' are actuated simultaneously from the master cylinder so that the plungers 108 and 108' project upwardly to predetermined substantially equal lengths. The complete or incomplete intermediate side wall portion 50 and the upper structural unit 46 forming part of the tank body 40 are bodily raised over the helical upper edge of the lower structural unit 44 and, as a consequence, produces an enlarged generally helical gap between the upper edge of the lower structural unit 44 and the lower edge of the complete or incomplete intermediate side wall portion 50 of the tank body 40. The chain 72 of the link units 74 and thereafter the carriers 52 can therefore be removed from between the upper and lower edges, respectively, of the lower structural unit 44 and the complete or incomplete intermediate side wall portion 50 of the tank body 40 through this enlarged gap. When the removal of the chain 72 and the carriers 52 is complete, the cylinders 104 and 104' are operated from the master cylinder so as to allow their plungers 108 and 108' to retract downwardly until the complete or incomplete intermediate wall portion 50 of the tank body 40 is supported along its helical lower edge on the helical upper edge of the lower structure 44. The complete or incomplete intermediate side wall portion 50 of the tank 40 is then edgewise welded to the lower structural unit 44 and, if the intermediate side wall portion 50 is left incomplete, the last additional structural member is welded to the lower structural unit 44 and the incomplete intermediate wall portion 50. The tank body 40 thus completed comprises lowermost and uppermost side wall portions resulting from the lower and upper structural units 44 and 46, respectively, and combined together by the intermediate side wall portion 50.

The drive units inside and outside the lowermost side wall portion of the tank body 40 are thereafter removed from the tank body in a suitable manner. The drive units located within the tank body 40 in particular may be moved out of the tank body 40 through a fluid inlet opening (not shown) usually provided at the bottom of the tank body 40 or may be moved out of the tank body 40 through the open space left formed between the lower structural unit 44 and the incomplete intermediate side wall portion 50 of the tank body 40 before the open space is closed by the last additional structural member.

Figure 7:
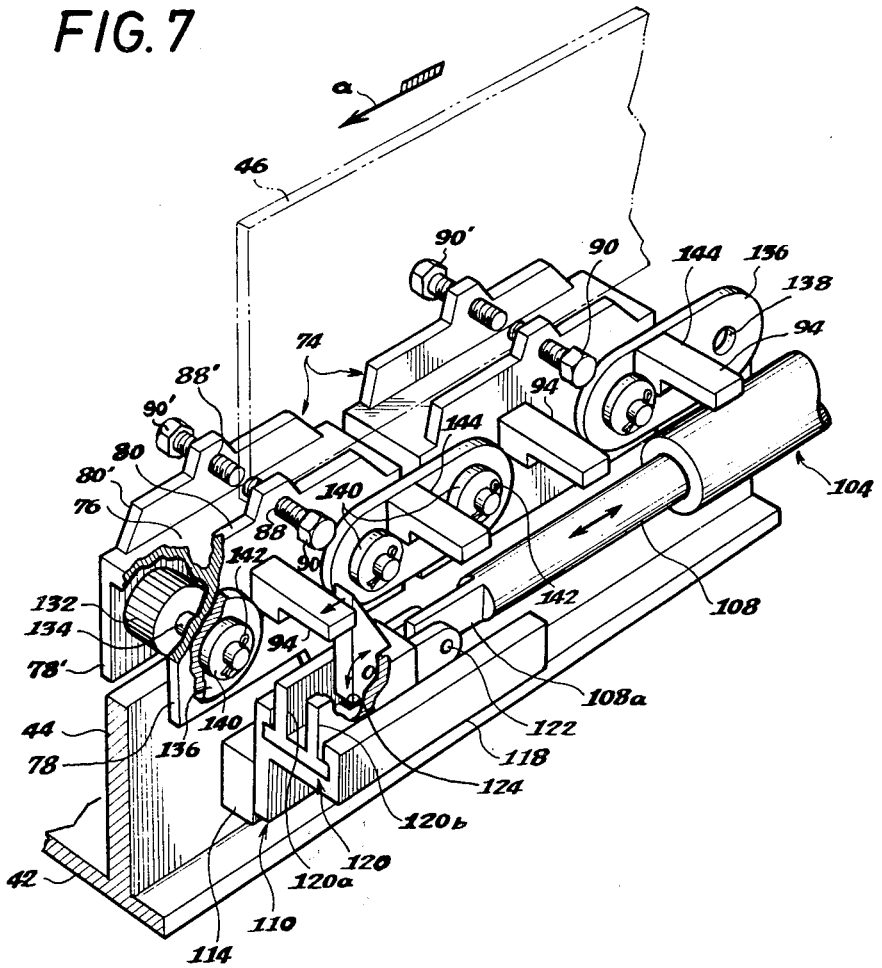
FIG. 7 is a view similar to FIG. 4 but shows part of another preferred embodiment of the arrangement according to the present invention.

FIG. 7 illustrates a modification of the tank building arrangement hereinbefore described with reference to FIGS. 4 to 6. While the carriers 52 used in the arrangement of FIGS. 4 to 6 are constructed separately of the open-end chain 72 of the link units 74, the counterparts of the carriers 52 are, in the arrangement of FIG. 7, mounted on the link units constituting an open-end chain. Each of the link units in the arrangement of FIG. 7 is in itself essentially similar in configuration to each of the link units 74 of the open-end chain 72 of the arrangement of FIGS. 4 to 6 and, thus, the corresponding portions of each link unit as well as the link units per se of the arrangement of FIG. 7 are designated by the same reference numerals as in FIGS. 4 and 6. The drive units used in the arrangement of FIG. 7 are also similar in construction to those of the arrangement of FIGS. 4 to 6.

In the tank building arrangement illustrated in FIG. 7, each of the link units 74 constituting the open-end chain has supported thereon a pair of spaced parallel rollers 132 each of which is mounted on a shaft 134 journalled to the lower side wall portions 78 and 78' of the link unit 74. The shaft 134 thus carrying the roller 132 extends substantially at right angles to the longitudinal direction of the link unit 74, viz., to the direction of movement of the open-end chain and has opposite end portions axially projecting laterally upwardly from the lower side wall portions 78 and 78', respectively. Each of the rollers 132 has its upper end slightly spaced apart from the lower face of the cross wall portion 76 of the link unit 74 and its axial ends substantially equally spaced apart from the inner side faces of the lower side wall portions 78 and 78', respectively. An elongated connecting element 136 having holes 138 in its end portions is slidably attached in part to the outer side face of each of the lower side wall portions 78 and 78' of one link unit 74 and in part to the outer side face of each of the lower side wall portions 78 and 78'0 of the link unit 74 next to the former. The shaft 134 carrying each of the rollers 132 has its opposite end portions projecting laterally outwardly from the connecting elements 136 thus attached to the outer side faces of the lower side wall portions 78 and 78' of each link unit 74 through the holes 138 in the connecting elements 136. A ring-shaped thrust bearing 140 is mounted on each of the projecting end portions of the shaft 134 and is held in slidable contact with the outer face of the connecting element 136 by means of suitable retaining means such a cotter pin 142 which is releasably inserted through a diametrical through hole (not shown) which is formed in each of the projecting end portions of the shaft 134. Furthermore, one of the lateral arms 94 projecting from one side of each of the link units 74 in the arrangement of FIGS. 4 to 6 is, in the arrangement of FIG. 7, constituted by a lateral arm 144 projecting perpendicularly from the outer side face of each of the connecting elements 136. Though not seen in FIG. 7, a lateral arm corresponding to the above mentioned lateral arm 144 is also mounted on the outer side face of the connecting element which is attached to the other side of each of the link units 74 in the arrangement of FIG. 7.

In comparison with the tank building arrangement of FIGS. 4 to 6 in which the carriers 52 and the chain 72 of the link units 74 must be mounted on or removed from the lower structural unit 44 separately, viz., by two steps, the arrangement of FIG. 7 is adapted to have the carriers and the chain of link units mounted on or removed from the lower structural unit 44 substantially by a single step. Another advantage of the arrangement of FIG. 7 over the arrangement of FIGS. 4 to 6 is that the meticulous and time-consuming work required to have the individual carriers accurately positioned at predetermined intervals on the lower structural unit when the arrangement of FIGS. 4 and 6 can be dispensed with. The method of building a fluid storage tank by the use of the arrangement of FIG. 7 is essentially similar to the method using the tank building arrangement of FIGS. 4 to 6 and will thus be self-explanatory from the detailed description which has been made with reference to FIGS. 3 to 6.

From the foregoing description, it will have been understood that the method and arrangement according to the present invention have the following major advantages over the previously described prior-art tank building techniques.

1. The carriers 52 in the arrangement of FIGS. 4 to 6 or the rollers 132 in the arrangement of FIG. 7 are located at substantially regular intervals on the helical upper edge of the lower structural unit throughout the length of the open-end chain 72 of the link units 74 so that the weight of the upper structural unit 46 or the sum of the weights of the upper structural unit 46 and the intermediate side wall portion 50 of the tank body 40 being constructed is uniformly transmitted to the lower structural unit 44.

2. Because of the fact that each of the fluid-operated cylinders 104 and 104' is directed and the plunger thereof is moved back and forth in parallel with the direction in which the helical lower edge of the upper structural unit 46 or of the intermediate side wall portion 50 being completed, no undue force is imparted to each of the cylinders 104 and 104' so that the upper structural unit 44 and thereafter the incomplete assembly of the structural unit 46 and the intermediate side wall portion 50 being constructed are moved regularly and uniformly and are maintained in correct weight transmitting relationship to the lower structural unit 44 throughout the operation to construct the tank body 40.

3. The plungers of the fluid-operated cylinders 104 and 104' being moved in parallel with the above mentioned direction, the driving forces of the cylinders are totally transmitted to the chain 72 of the link units 74 and, for this reason, there is no need of using a great number of fluid-operated cylinders and/or heavy-duty and accordingly large-sized cylinders.

4. Since only the carriers 52 or rollers 132 and the cross wall portions 76 of the link units 74 of the chain 72 are located between the upper edge of the lower structural unit 44 and the lower edge of the upper structural unit 46 or the intermediate side wall portion 50 being constructed, the upper structural unit 44 or the intermediate side wall portion 50 being constructed needs to be raised over the upper edge of the lower structural unit only a distance equal to the sum of the thickness of the cross wall portion 76 of each link unit 74 and the diameter (which is about 28 to 45 millimeters as previously noted) of the rollers 54 of each of the carriers 52 in the arrangement of FIGS. 4 to 6 or to the sum of the thickness of the cross wall portion 76, the diameter of the rollers 132 on each of the link units 74 and a small allowance between the lower face of the cross wall portion 76 and each of the rollers 132 in the arrangement of FIG. 7. This not only assures security in positioning the upper structural unit 46 and the incomplete assembly of the structural unit 46 and the intermediate side wall portion 50 being constructed but provides ease of removing the chain 72 of the link units 74 and the carriers 52 from the tank body 40 which is completed or about to be completed. In this connection it may be mentioned that the gap formed between the lower structural unit 44 and the upper structural unit 46 or the intermediate side wall portion 50 being constructed measures about 60 millimeters for a large-sized petroleum storage tank and about 40 millimeters for a smallsized petroleum storage tank, according to the inventor's practical experiences.

5. Because, furthermore, the upper structural unit 46 or the intermediate side wall portion 50 being constructed bears along its lower edge against the flat upper faces of the cross wall portions 76 of the individual link units 74 of the chain 72 and is held in position aligned with the lower structural unit 44 by the bolts 92 and 92' on the upper side wall portions 80 and 80', respectively, of the link units 74, there is no need of applying extra protective and/or guide means such as the grooved guide member 22 in the prior-art arrangement of FIG. 1 to the lower edge of the upper structural unit 44 or the intermediate side wall portion 50 being constructed. This is also conductive to reducing the gap between the lower structural unit 44 and the upper structural unit 46 or the intermediate side wall portion 50 being constructed.

While the method and arrangement according to the present invention have been described as being used for the construction of a fluid storage tank, it will be apparent that the present invention can be utilized for the construction or formation of any other kinds of cylindrical hollow structures having open or closed tops and/or bottoms. Although, furthermore, the drive units for the open-end chain 72 have been described and shown to be provided on both of the inner and outer peripheral surfaces of the lower structural unit 44, this is merely for the purpose of illustration and, thus, the drive units may be provided on only one side of the lower structural unit 44. If the drive units are provided on both sides of the structural unit 44, the drive units on both sides of the structural unit 44 may be arranged in staggered relationship to each other.

What is claimed is:

1. A method of building a cylindrical hollow structure, comprising (1) preparing separate lower and upper structural units having substantially congruent circular cross sections, the lower structural unit having a helical upper edge having lowermost and uppermost ends and continuously sloping upwardly from the lowermost end to the uppermost end and a vertical edge joining the lowermost and uppermost ends and the upper structural unit having a helical lower edge having uppermost and lowermost ends and continuously sloping downwardly from the uppermost end to the lowermost end of the lower edge and a vertical edge joining the uppermost and lowermost ends of said lower edge, the respective helix curves of the helical upper and lower edges of the lower and upper structural units being substantially identical with each other, (2) positioning a pliurality of carriers on said helical upper edge at predetermined intervals substantially throughout the length of the upper edge, each of said carriers being in rollable contact with said helical upper edge, and an open-end chain of link units on said carriers, said link units being pivotally connected to one another and each having a cross wall portion having substantially flat lower and upper faces located over the adjacent portion of said helical upper edge, each of said link units having at least one of said carriers located below the cross wall portion thereof, (3) mounting said upper structural unit on said chain in weight transmitting relationship to said lower structural unit through the respective cross wall portions of said link units and said carriers, said vertical edge of the upper structural unit being located adjacent to said vertical edge of the lower structural unit, (4) intermittently driving said chain for stepwise moving the chain upwardly along said helical upper edge of the lower structural unit with said carriers in rolling contact with the helical upper edge, the upper structural unit being thereby stepwise rotated about the vertical center axis thereof and moved upwardly over the lower structural unit and the vertical edge of the upper structural unit being stepwise spaced apart from the vertical edge of the lower structural unit for forming a generally parallelogrammic open space between the vertical edges, (5) securely connecting an additional structural member edgewise to the upper structural unit through said open space, the additional structural unit thus connected to the upper unit having a vertical edge slightly spaced apart from said vertical edge of the lower structural unit, (6) repeating the step of (5) a predetermined number of times for successively applying a plurality of additional structural members to the upper structural unit and the structural members precedingly applied to the upper structural unit for forming part of an intermediate side wall portion of the hollow structure to be built, (7) further applying additional structural members to the intermediate side wall portion being constructed and to the structural members precedingly applied to the incomplete intermediate side wall portion until the upper structural unit is raised to a desired level, (8) lifting the intermediate side wall portion and the upper structural unit above said chain, and (9) removing said chain and said carriers from the lower structural unit and the intermediate side wall portion.

2. A method as set forth in claim 1, in which said chain is intermittently driven by driving forces which are substantially totally directed in parallel with the helical upper and lower edges of the lower and upper structural units, respectively.

3. A method as set forth in claim 2, in which said driving forces are applied to said chain on both sides of the chain.

4. An arrangement for building a cylindrical hollow structure comprising lowermost and uppermost side wall portions and an intermediate side wall portion between the lowermost and uppermost side wall portions, the lowermost and uppermost side wall portions respectively resulting from lower and upper structural units having helical upper and lower edges, respectively, said arrangement comprising a plurality of carriers to be rollably mounted at predetermined intervals on the helical upper edge of said lower structural unit, an open-end chain composed of a number of link units which are pivotally connected to one another each with a horizontal pivotal axis directed at right angles to the direction of elongation of the chain, each of said link units having a cross wall portion having substantially flat lower and upper faces, each link unit being adapted to be mounted on at least one of said carriers on said upper edge of said lower structural unit with the lower face of said cross wall portion located above said at least one of the carriers, the upper faces of the respective cross wall portions of the link units being adapted to receive the helical lower edge of said upper structural unit, and drive means to be mounted on at least one of the inner and outer peripheral surfaces of the lower structural unit and located to be engageable with said link units for intermittently applying driving forces to said chain for stepwise moving the chain upwardly along the upper helical edge of the lower structural unit, said drive means being operative so that the driving forces applied from the drive means to said chain are substantially totally parallel with the helical upper and lower edges of the lower and upper structural units, respectively.

5. An arrangement as set forth in claim 4, in which each of said link units has mounted thereon at least one lateral arm projecting laterally outwardly from each side of the link unit, said drive means being engageable with the lateral arms of the individual link units.

6. An arrangement as set forth in claim 5, in which the lateral arms on each side of said chain are arranged at constant intervals in the direction of elongation of the chain.

7. An arrangement as set forth in claim 6, in which said drive means comprise two sets of drive units, each set of drive units being provided on each of the inner and outer peripheral surfaces of said lower structural unit and engageable with the lateral arms projecting from each side of said chain.

8. An arrangement as set forth in claim 7, in which each of said drive units includes a fluid-operated cylinder which is rotatable about a fixed axis substantially normal to the adjacent peripheral surface portion of said lower structural unit and which has an elongated plunger which is axially movable toward and away from said fixed axis, said cylinder being rotatable about said fixed axis between a first angular position substantially vertically projecting from said fixed axis and a second angular position substantially parallel with the adjacent portion of said helical upper edge of the lower structural unit, the cylinder in said second angular position extending below said lateral arms projecting from each side of said chain, guide rail means to be fixedly and detachably mounted on each of the inner and outer peripheral surfaces of the lower structural unit and elongated substantially in parallel with the adjacent portion of the helical upper edge of the lower structural unit, a slider longitudinally slidably on said guide rail means toward and away from said fixed axis, cylinder having its plunger disengageably connected to said slider for moving the slider on said guide rail means toward and away from said fixed axis when said cylinder is actuated, a thrust member rotatable about an axis fixed on said slider and directed perpendicularly to the direction of movement of the slider, the thrust member being rotatable about the axis thereof between a first position engageable with the rear end of one of said lateral arms on each side of said chain, said rear end being in the direction of movement of the chain, and a second position slidable on the lower end of one of the lateral arms on each side of said chain, and biasing means urging said thrust member toward said first position, said cylinder being operative to move said plunger back and forth through a distance which is substantially equal to each of said comstant intervals between said lateral arms so that said thrust member is moved together with said slider intermittently into the first position thereof back from the second position thereof as the cylinder held in said second angular position thereof is actuated to have the plunger alternately moved axially toward and away from said fixed axis.

9. An arrangement as set forth in claim 8, in which each of said units further has a pair of spaced parallel lower side wall portions laterally spaced apart from the inner and outer peripheral surfaces of said lower structural unit and having said at least one of said carriers positioned therebetween, the spacing between said lower side wall portions being such that the link unit is laterally movable relative to said lower structural unit a distance through which the lateral arms on each of said chain are movable from above said cylinder.

10. An arrangement as set forth in claim 9, in which each of said link units comprises a pair of elongated elements which are length adjustably and detachably passed substantially perpendicularly through said lower side wall portions, respectively, and substantially aligned with each other laterally of the link unit.

11. An arrangement as set forth in claim 10, in which eacn of said link units further has a pair of spaced parallel upper side wall portions projecting upwardly from said cross wall portion, each link unit further comprising a pair of elongated elements which are length adjustably and detached passed substantially perpendicularly through said upper side wall portions and substantially alinged with each other laterally of said link unit.

12. An arrangement as set forth in claim 9, in which each of said carriers comprises a pair of spaced parallel rollers each having an axial bore with open ends, a pair of link members each having a pair of spaced parallel cantilever shafts, one of the shafts on each of said link members being inserted into the axial bore in one of said rollers from each of the open ends of the bore and the other shafts on said link members being inserted into the axial bore in the other roller so that each of said rollers is rotatable on the shafts inserted into the axial bore therein, each of said shafts being formed with an internally threaded bore which is open through an aligned hole in the link member supporting the shaft, and a pair of elongated threaded elements each of which is screwed into the internally threaded bores in the shafts inserted into the axial bore in each of said rollers, the outer side faces of said link members being spaced apart from each other a distance greater than the spacing between said lower side wall portions of each of said link units, the rollers of each of said carriers being rolling contact at their lower ends with the helical upper edge of said lower structural unit and at their upper ends with said flat lower face of said cross wall portion of the link unit when said chain is moved along said helical upper edge.

13. An arrangement as set forth in claim 9, in which each of said carriers comprises a roller rotatable on a shaft supported on said lower side wall portions of each of said link units and extending laterally of the link unit, the roller being in rolling contact with said helical upper edge of the lower structural unit when said chain is moved along said helical upper edge.

14. An arrangement as set forth in claim 13, in which said link units are connected to one another by connecting elements each of which is pivotally connected at one end to one side of one link unit and at the other to one side face of the link unit next to said one link unit, each of said connecting element having fixedly mounted thereon at least one of said lateral arms.

* * * * *